US008596226B2

(12) United States Patent
McAnally et al.

(10) Patent No.: US 8,596,226 B2
(45) Date of Patent: Dec. 3, 2013

(54) WATER HEATER BURNER TUBE AND DOOR ASSEMBLY

(75) Inventors: Marcus E. McAnally, Nashville, TN (US); Duane A. Lee, Johnson City, TN (US); Rodney R. Syler, Franklin, TN (US); Emadeddin Y. Tanbour, Johnson City, TN (US); Mark A. Murphy, Nashville, TN (US)

(73) Assignee: AOS Holding Company, Wilmington, DE (US)

( * ) Notice: Subject to any disclaimer, the term of this patent is extended or adjusted under 35 U.S.C. 154(b) by 1171 days.

(21) Appl. No.: 12/431,525

(22) Filed: Apr. 28, 2009

(65) Prior Publication Data

US 2010/0154724 A1 Jun. 24, 2010

Related U.S. Application Data

(60) Provisional application No. 61/140,483, filed on Dec. 23, 2008.

(51) Int. Cl.

| | |
|---|---|
| ***F24H 1/18*** | (2006.01) |
| ***F24H 9/12*** | (2006.01) |
| ***F16L 5/00*** | (2006.01) |

(52) U.S. Cl.

USPC ..... 122/17.1; 122/498; 285/139.1; 285/141.1

(58) Field of Classification Search

USPC ..... 122/13.01, 17.1, 19.1, 19.2, 494, 498; 285/136.1, 137.11, 139.1, 139.3, 141.1

See application file for complete search history.

(56) References Cited

U.S. PATENT DOCUMENTS

| | | | |
|---|---|---|---|
| 196,084 | A | 10/1877 | Guyer |
| 1,253,065 | A | 1/1918 | Looze |
| 2,070,535 | A | 2/1937 | Hansen |
| 2,334,398 | A | 11/1943 | Farren et al. |
| 3,209,991 | A | 10/1965 | Sauber |
| 3,827,727 | A | 8/1974 | Moebius |
| 3,871,800 | A | 3/1975 | Slayton |

(Continued)

FOREIGN PATENT DOCUMENTS

| | | |
|---|---|---|
| CA | 2228569 | 8/1999 |
| CA | 2475065 | 11/2002 |

(Continued)

OTHER PUBLICATIONS

Rheem Design Pictures, dated May 19, 2008.

(Continued)

*Primary Examiner* — John K Fristoe, Jr.
*Assistant Examiner* — Atif Chaudry
(74) *Attorney, Agent, or Firm* — Michael Best & Friedrich LLP

(57) ABSTRACT

A burner tube and door assembly for a water heater includes a burner tube and a fuel supply line in telescoping relationship to define a tube junction. The tube junction extends through the door of a water heater. One of the tube and line includes an enlarged portion. A lock ring applies a radially-directed force around a portion of the tube junction. The enlarged portion and lock ring are on opposite sides of the door to secure the door to the burner tube and fuel supply line. The enlarged portion and lock ring apply a compressive load to the door to resist rotation of the door with respect to the tube junction.

19 Claims, 9 Drawing Sheets

(56) References Cited

U.S. PATENT DOCUMENTS

| | | | | |
|---|---|---|---|---|
| 3,920,375 | A | 11/1975 | Sanderson et al. | |
| 4,026,006 | A | 5/1977 | Moebius | |
| 4,061,367 | A | 12/1977 | Moebius | |
| 4,606,562 | A * | 8/1986 | Saraceno | 285/149.1 |
| 4,669,448 | A | 6/1987 | West | |
| 4,858,968 | A | 8/1989 | Moebius | |
| 4,924,816 | A | 5/1990 | Moore, Jr. et al. | |
| 4,973,482 | A | 11/1990 | Morris, II et al. | |
| 5,020,512 | A | 6/1991 | Vago et al. | |
| 5,386,923 | A | 2/1995 | Nakashima et al. | |
| 5,934,269 | A | 8/1999 | Wilson | |
| 5,971,444 | A * | 10/1999 | Hawkins | 285/206 |
| 6,109,216 | A | 8/2000 | Reynolds et al. | |
| 6,216,643 | B1 | 4/2001 | Reynolds et al. | |
| 6,230,665 | B1 | 5/2001 | Reynolds et al. | |
| 6,257,846 | B1 | 7/2001 | Muramatsu et al. | |
| 6,269,779 | B2 | 8/2001 | Overbey, Jr. | |
| 6,295,952 | B1 | 10/2001 | Reynolds et al. | |
| 6,302,062 | B2 | 10/2001 | Overbey, Jr. et al. | |
| 6,439,171 | B1 | 8/2002 | McCall | |
| 6,446,582 | B1 | 9/2002 | Duong et al. | |
| 6,517,344 | B2 * | 2/2003 | Scanlon | 431/343 |
| 6,547,558 | B2 | 4/2003 | McCall | |
| 6,554,322 | B2 | 4/2003 | Duong et al. | |
| 6,554,610 | B2 | 4/2003 | McCall | |
| 6,698,385 | B1 | 3/2004 | Lesage | |
| 7,000,847 | B2 | 2/2006 | Alvarado | |
| 7,032,543 | B1 | 4/2006 | Akkala et al. | |
| 7,198,304 | B2 | 4/2007 | Angus | |
| 7,946,257 | B2 | 5/2011 | Hicks et al. | |
| 8,091,927 | B2 | 1/2012 | Scanlon | |
| 2002/0068253 | A1 | 6/2002 | Scanlon | |
| 2007/0117060 | A1 | 5/2007 | Scanlon | |
| 2008/0213709 | A1 | 9/2008 | Clayton et al. | |
| 2009/0084328 | A1 | 4/2009 | Lyons et al. | |
| 2009/0302603 | A1 | 12/2009 | Clayton | |
| 2010/0154724 | A1 | 6/2010 | McAnally et al. | |
| 2011/0020759 | A1 | 1/2011 | Clayton | |
| 2012/0007355 | A1 | 1/2012 | Scanlon | |

FOREIGN PATENT DOCUMENTS

| | | |
|---|---|---|
| CA | 2582285 | 9/2007 |
| GB | 397360 | 8/1933 |
| GB | 2034393 | 6/1980 |
| JP | 2001254834 | 9/2001 |
| KR | 20070028018 | 3/2007 |

OTHER PUBLICATIONS

U.S. Appl. No. 12/233,043, Tanbour et al., filed Sep. 18, 2008.
U.S. Appl. No. 12/260,259, Tanbour et al., filed Oct. 29, 2008.
U.S. Appl. No. 12/260,224, Tanbour et al., filed Oct. 29, 2008.
U.S. Appl. No. 12/260,200, Tanbour et al., filed Oct. 29, 2008.
U.S. Appl. No. 12/260,233, Tanbour et al., filed Oct. 29, 2008.
U.S. Appl. No. 12/505,515, filed Jul. 19, 2009.

* cited by examiner

WATER HEATER BURNER TUBE AND DOOR ASSEMBLY

The present application claims priority to U.S. Provisional Patent Application No. 61/140,483 filed Dec. 23, 2008.

BACKGROUND

The present invention relates to a burner tube and door assembly for a water heater. The assembly rigidly interconnects a burner tube, door, and fuel supply tube. A burner is supported by the burner tube. The entire assembly, including the burner is removed from the water heater when the door is removed from the water heater skirt.

SUMMARY

In one embodiment, the invention provides a water heater comprising: a water storage tank; a combustion chamber having an access opening; a door adapted to cover the access opening, the door including a hole having a hole diameter, and including an inner surface facing the combustion chamber and an outer surface facing away from the combustion chamber; a burner tube including an enlarged diameter portion having a outer diameter larger than the hole diameter, a first end on a first side of the enlarged diameter portion and extending into the combustion chamber, and a second end on a second side of the enlarged diameter portion opposite the first side, the first end defining a fuel delivery orifice, the second end having an outer diameter smaller than the hole diameter and extending through the hole in the door; a burner mounted to the first end of the burner tube and adapted to receive fuel from the fuel delivery orifice to create products of combustion to heat water in the storage tank; a fuel supply line having a first end adapted for connection to a source of fuel and a second end extending into the second end of the burner tube to define a tube junction; and a lock ring having an outer diameter larger than the hole diameter, the lock ring surrounding at least a portion of the tube junction and applying a radially-directed force around a circumference of the tube junction to resist removal of the fuel supply line from the burner tube; wherein the enlarged diameter portion of the burner tube resists movement of the first end of the burner tube out of the combustion chamber through the hole in the door; and wherein the lock ring resists movement of the supply line into the combustion chamber through the hole in the door.

In some embodiments, the lock ring, door, enlarged diameter portion, second end of the burner tube, and second end of the supply line interact to apply compression on the door between the lock ring and enlarged portion to resist relative rotation between the door and the burner tube. In some embodiments, the water heater further comprises at least one washer between the door and at least one of the enlarged diameter portion of the burner tube and the lock ring. In some embodiments, the at least one washer includes at least one lock washer compressed between the door and at least one of the enlarged diameter portion and the lock ring. In some embodiments, the at least one washer includes a lock washer compressed between the enlarged diameter portion and the inner surface of the door and a lock washer compressed between the lock ring and the outer surface of the door. In some embodiments, the second end of the fuel supply line includes a reduced diameter portion, a larger diameter portion, and a shoulder in between the reduced diameter portion and larger diameter portion; wherein the reduced diameter portion extends into the second end of the burner tube until the burner tube abuts the shoulder; wherein the larger diameter portion has an outer diameter that is less than the outer diameter of the second end of the burner tube; and wherein the lock ring is slid axially off the larger diameter portion and onto the second end of the burner tube during assembly to give rise to the radially-directed force around the entire circumference of the tube junction.

The invention also provides a burner tube and door assembly comprising: a door including an opening, and including oppositely-facing inner and outer surfaces; a burner tube including opposite first and second ends, the first end of the burner tube adapted to support and deliver gaseous fuel to a burner; a fuel supply line including opposite first and second ends, the first end of the fuel supply line adapted to interconnect to a source of gaseous fuel, the second end of the fuel supply line sized to interconnect with the second end of the burner tube in telescoping relationship to define a tube junction; and a lock ring applying a radially-directed force around a portion of the tube junction to resist relative movement of the second ends of the burner tube and fuel supply line; wherein one of the burner tube and fuel supply line includes an enlarged portion that resists movement of the tube junction in a first direction through the opening in the door; and wherein the lock ring resists movement of the tube junction in a second direction through the opening in the door.

In some embodiments, the burner tube includes the enlarged portion; and the second end of the fuel supply line extends into the second end of the burner tube. In some embodiments, the assembly further comprises at least one washer between the door and at least one of the enlarged portion and the lock ring. In some embodiments, the at least one washer includes at least one lock washer compressed between the door and at least one of the enlarged portion and the lock ring. In some embodiments, the at least one washer includes a lock washer compressed between the enlarged portion and an inner surface of the door and a lock washer compressed between the lock ring and an outer surface of the door. In some embodiments, the lock ring, door, enlarged portion, second end of the burner tube, and second end of the supply line interact to apply compression on the door between the lock ring and enlarged portion to resist relative rotation between the door and the burner tube. In some embodiments, the radially-directed force mechanically deforms the tube junction.

The invention also provides a method of assembling a burner tube and door assembly for a water heater, the method comprising the steps of: (a) providing a door having an opening; (b) providing a burner tube; (c) forming an enlarged portion in the burner tube to divide the burner tube into a first end on a first side of the enlarged portion and a second end on a second side of the enlarged portion opposite the first side, the enlarged portion being larger than a portion of the opening; (d) extending the second end of the burner tube through the opening; (e) providing a fuel supply line having a first end adapted for connection to a source of fuel and a second end opposite the first end; (f) extending the second end of the fuel supply line into the second end of the burner tube to define a tube junction; and (g) positioning a lock ring around the tube junction to give rise to a radially-directed force around a circumference of the tube junction to resist removal of the fuel supply line from the burner tube.

In some embodiments, the method further comprises: prior to step (g), compressing the door between the lock ring and enlarged portion; and following step (g), maintaining compression on the door between the lock ring and enlarged portion. In some embodiments, the method further comprises the step of positioning at least one washer between the door and at least one of the enlarged diameter portion of the burner tube and the lock ring. In some embodiments, the method further comprises the step of positioning a lock washer between the enlarged portion and the door, wherein step (g) includes compressing the door between the enlarged portion and the lock ring, with the lock washer being deformed between the enlarged portion and the door to resist rotation of the door with respect to the burner tube. In some embodiments, the method further comprises the step of positioning a lock washer between the lock ring and the door, wherein step (g) includes compressing the door between the enlarged portion and the lock ring, with the lock washer being deformed between the lock ring and the door to resist rotation of the door with respect to the burner tube. In some embodiments, step (g) includes mechanically deforming the tube junction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
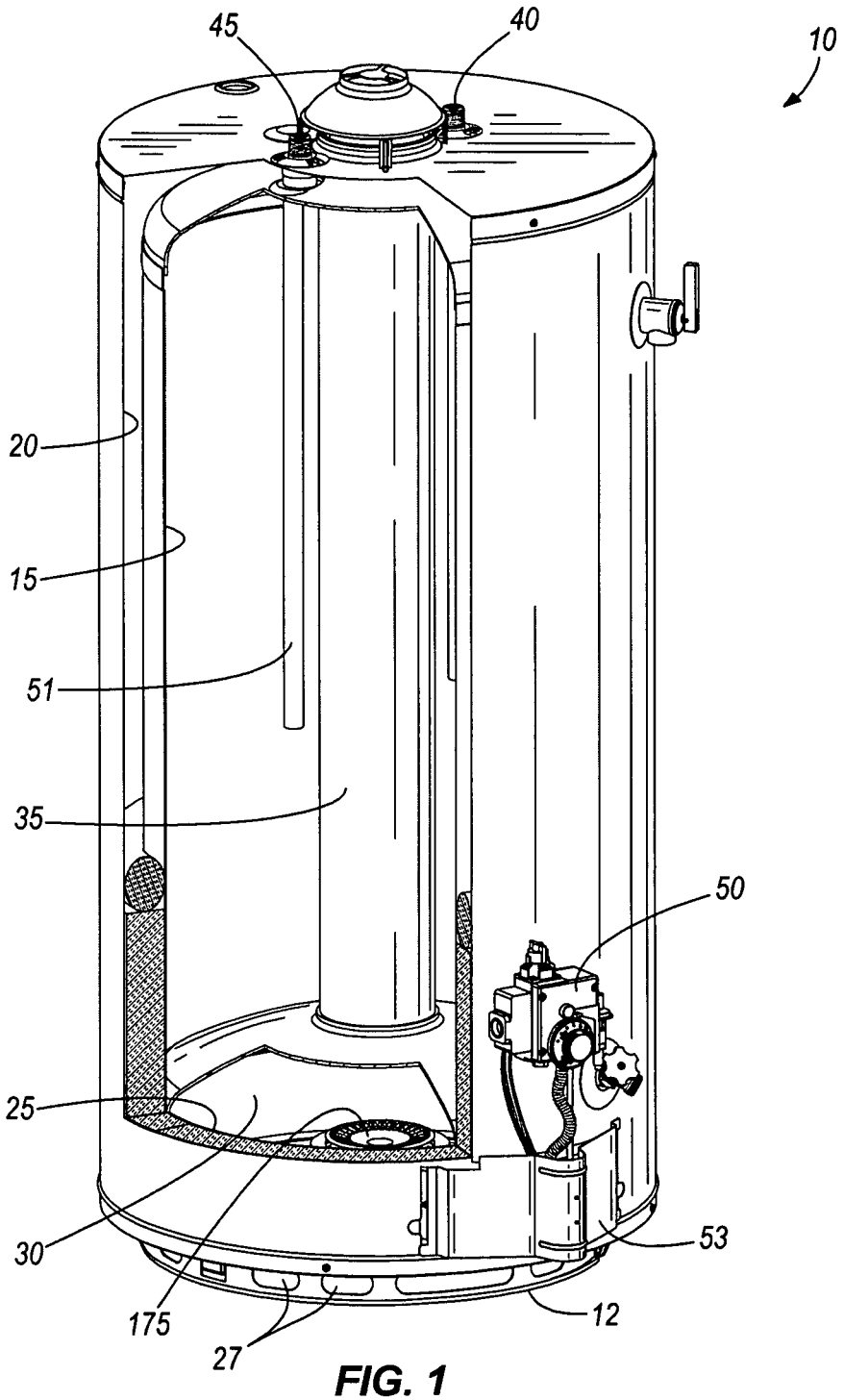
FIG. 1 is a perspective view of a water heater including a burner tube and door assembly according to the present invention.
Figure 2:
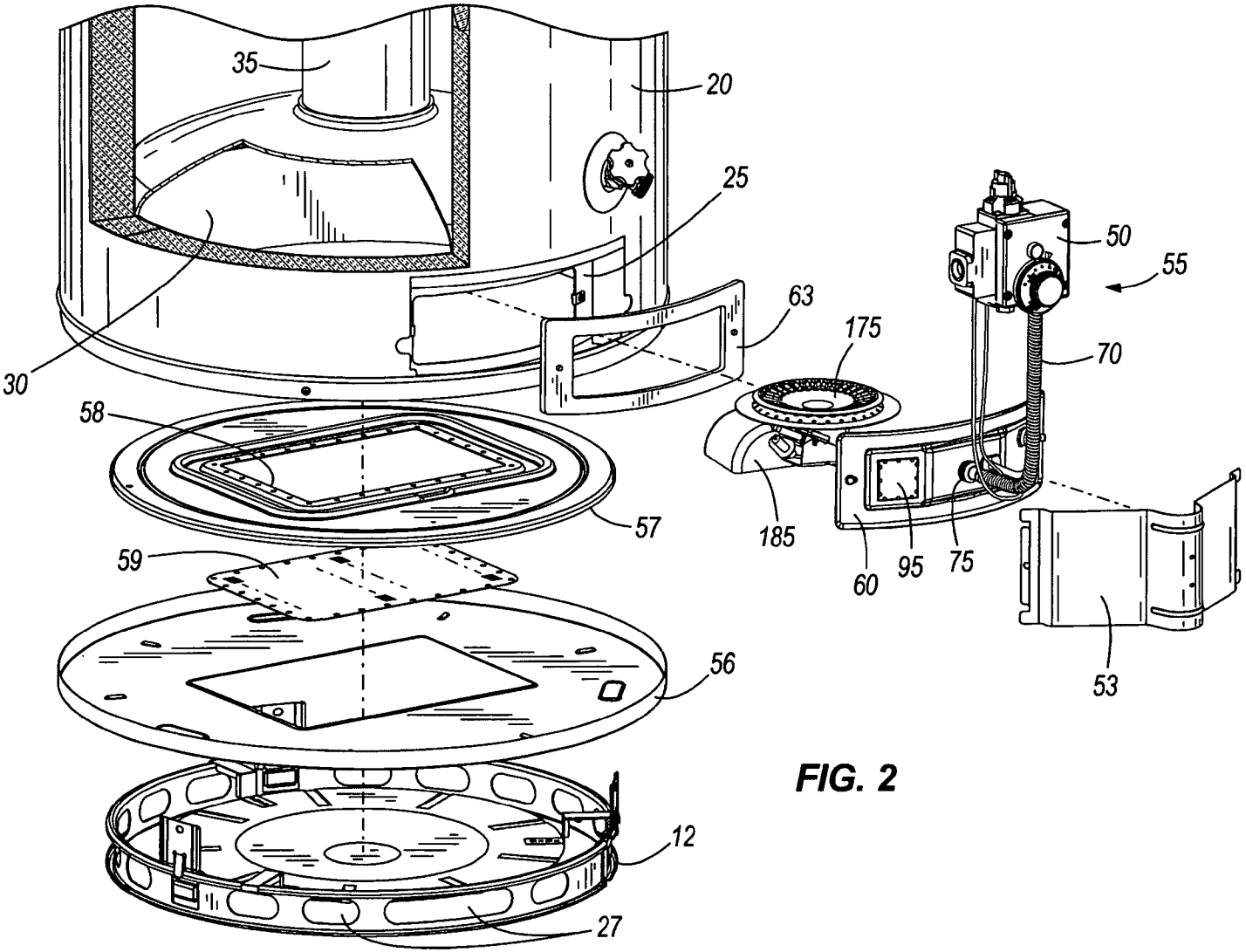
FIG. 2 is an exploded view of a lower portion of the water heater of FIG. 1.

FIGS. 1 and 2 illustrate a water heater 10 that includes a base pan or base ring 12, a storage tank 15, and an insulating jacket 20. The storage tank 15 is supported by a skirt 25 that partially defines a combustion chamber 30 below the storage tank 15. The base ring 12 supports the skirt 25 and storage tank 15, and includes air inlets 27 for the inflow of combustion air into the combustion chamber 30. A flue 35 extends from the combustion chamber 30 through the water in the storage tank 15, and out a top of the storage tank 15. A cold water inlet spud 40 and a hot water outlet spud 45 are mounted around holes in the top of the storage tank 15 for the respective provision of cold water to the storage tank 15 and removal of hot water from the storage tank 15 during performance draws. The water heater 10 may also include a sacrificial anode 51 to protect the tank 15 walls from corrosion or reduce the rate at which such walls may corrode or rust. A gas valve 50 is connected to a supply of gaseous fuel such as natural gas or propane.

With reference to FIG. 2, an outer door 53 is secured to the jacket 20, and covers a tube-door assembly 55 that is connected to the gas valve 50. Mounted on the base ring 12 is a jacket support 56 on which the bottom of the jacket 20 rests and a combustion chamber bottom 57 having a window 58. A flame trap 59 is mounted in the window 58 to permit the ingress of air into the combustion chamber 30 but to reduce the likelihood of the egress of flame due to a flashback incident involving flammable vapors around the water heater 10.

Figure 3:
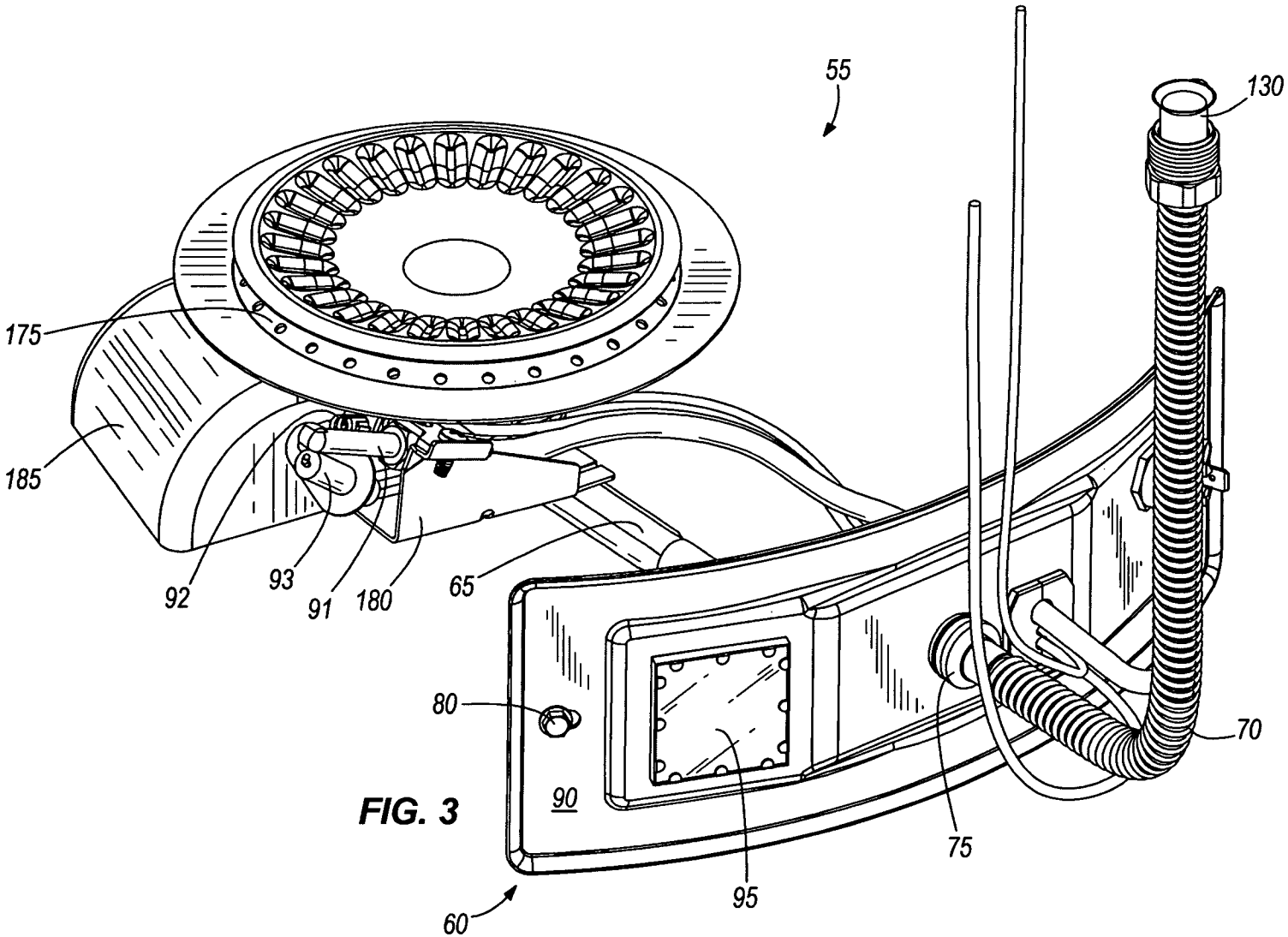
FIG. 3 is a first perspective view of a first embodiment of the burner tube and door assembly.
Figure 4:
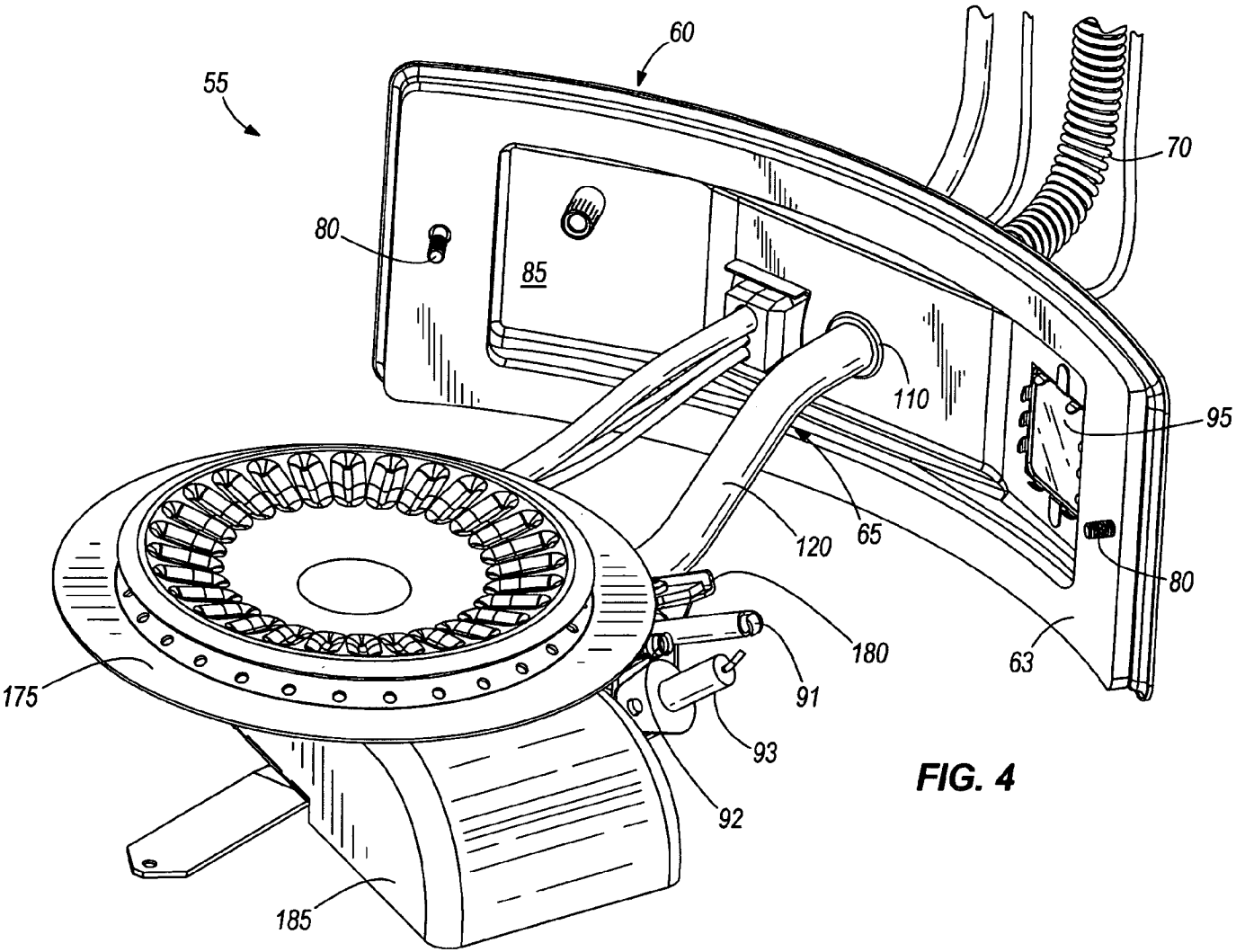
FIG. 4 is a second perspective view of the burner tube and door assembly of FIG. 3.
Figure 5:
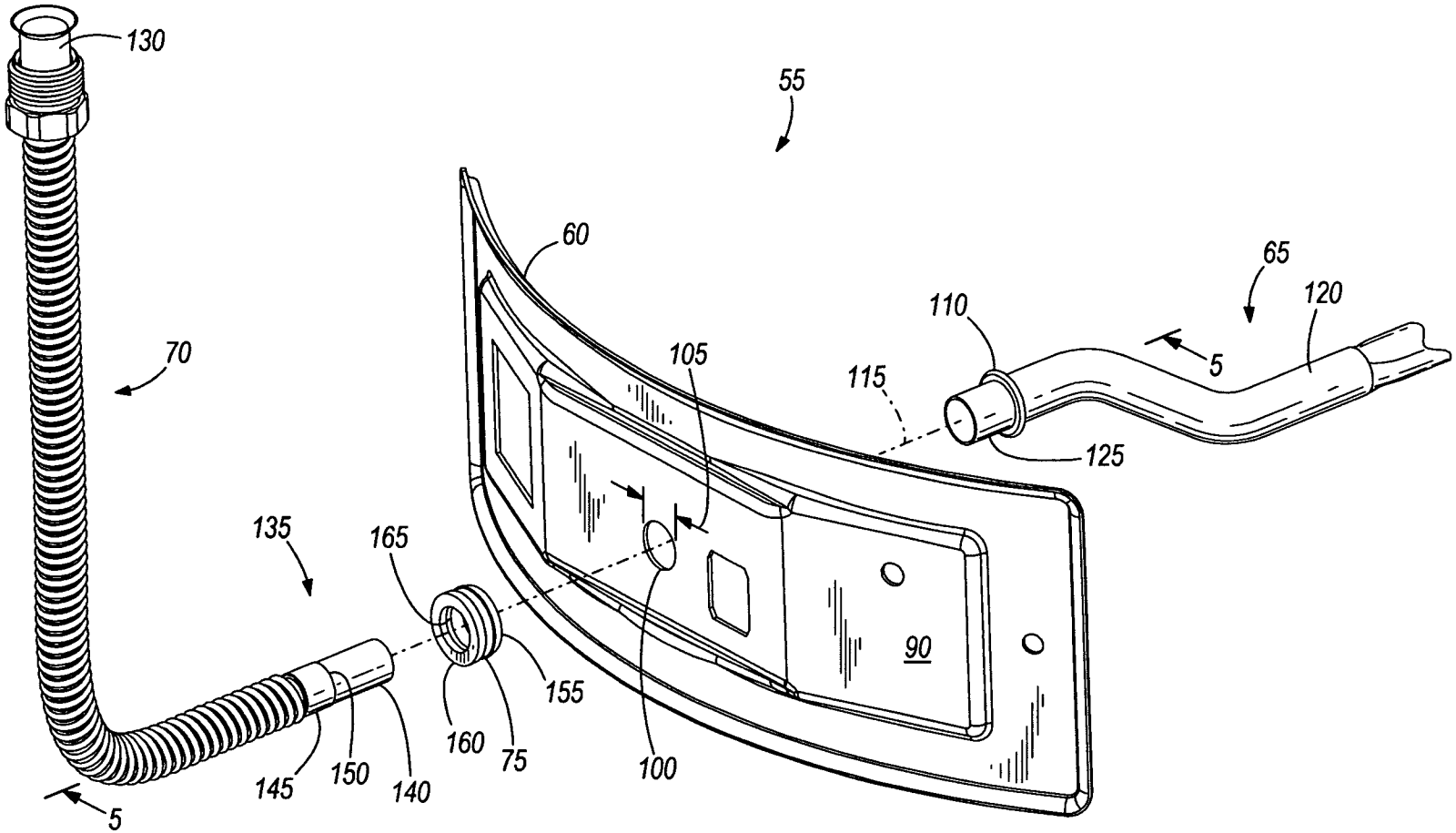
FIG. 5 is an exploded view of the burner tube and door assembly of FIG. 3.

With reference to FIGS. 3-5, the tube-door assembly 55 includes a door 60, a gasket 63, a burner tube 65, a gas supply line 70 or fuel supply line, and a lock ring 75. The door 60 covers an opening in the water heater skirt 25 and is secured to the skirt 25 with fasteners 80. The door 60 has an inner side 85 or inner surface that faces into the combustion chamber 30 and an outer side 90 or outer surface that faces away from the combustion chamber 30. The gasket 63 provides a substantially airtight seal between the inner side 85 of the door 60 and the skirt 25 when the door 60 is mounted to the skirt 25. Additionally, all elements passing through the door 60 (e.g., the illustrated pilot flame line 91, thermocouple 92, and pilot flame igniter 93) are sealed to the door 60 such that the combustion chamber 30 is generally air-tightly sealed except for the window 58 and the flue 35. The door 60 further includes a sight glass 95 to permit an operator to look into the combustion chamber 30 without removing the door 60 from the skirt 25. The door 60 also includes a hole 100 (FIG. 5), which in the illustrated embodiment is a circular hole 100 having a hole diameter 105.

The burner tube 65, which may be formed of a hard, high carbon steel in some embodiments and may alternatively be referred to as a gas supply tube, includes an enlarged diameter portion defined by a bead 110 or bulge. The bead 110 is formed in the burner tube 65 by a tube beading process in which a portion of the burner tube 65 is captured in a fixture or clamp, then axially (i.e., in a direction parallel to a longitudinal axis 115, see FIG. 5, of the burner tube 65) pushing on the free end of the burner tube 65 to cause bulging of the burner tube 65 adjacent the clamp. It should be noted that the term "axial" and variations thereof as used with respect to an elongated element (e.g., a tube or supply line) in the present invention means in a direction generally parallel to the longitudinal axis 115 of the element, or generally parallel to the longitudinal axis 115 of the relevant portion of the element in the event that the overall element is not straight. Continued axial force applied to the free end flattens the bulge into the flange-shaped bead 110 illustrated.

A first end 120 of the burner tube 65 is defined on one side of the bead 110, extends into the combustion chamber 30, and includes a fuel delivery orifice. A second end 125 of the burner tube 65 is defined on a second side of the bead 110 (opposite the first side). The first end 120 is generally longer than the second end 125. In the illustrated embodiment, the second end 125 has an outer diameter that is slightly smaller than the hole diameter 105 such that the second end 125 can extend through the hole 100.

The gas supply line 70, which is constructed of a flexible material or is corrugated to permit relatively easy manipulation and shaping in some embodiments and may alternatively be referred to as a fuel supply line, includes a first end 130 that communicates with the gas valve 50 to receive fuel from the source of gaseous fuel, and includes a second end 135. As seen in particularly well in FIG. 5, the second end 135 includes a reduced diameter portion 140, a larger diameter portion 145, and a shoulder 150 in between the two portions 140, 145. The reduced diameter portion 140 defines a free end of the gas supply line 70. In the illustrated embodiment, the reduced diameter portion 140 has an outer diameter smaller than the inner diameter of the second end 125 of the burner tube 65, and the reduced diameter portion 140 may therefore be slid into the second end 125 of the burner tube 65. The burner tube 65 and fuel supply line 70 may be said to be in telescoping relationship with each other.

The larger diameter portion 145 has an outer diameter that is larger than the inner diameter of the second end 125 of the burner tube 65, but smaller than the outer diameter of the second end 125 of the burner tube 65. Consequently, the second end 125 of the burner tube 65 abuts the shoulder 150 when the reduced diameter portion 140 is fully extended into the second end 125 of the burner tube 65. In the illustrated embodiment (see FIGS. 6 and 7), the free end of the gas supply line 70 extends beyond the bead 110 and into the first end 120 of the burner tube 65. A tube joint or tube junction is defined where the second end 125 of the burner tube 65 overlaps the reduced diameter portion 140 of the gas supply line 70. A sealant may be applied between the reduced diameter portion 140 of the gas supply line 70 and the second end 125 of the burner tube 65 to resist escape of gaseous fuel from the tube joint.

The lock ring 75 extends around the tube joint. The lock ring 75 may be of the type described in U.S. Pat. No. 4,858,968, and includes a first end 155, a second end 160, and a tapered bore 165 that has a larger diameter at the first end 155 than at the second end 160. Even at its smallest diameter, however the bore 165 fits around the larger diameter portion 145 of the gas supply line 70 without applying significant compressive forces on the larger diameter portion 145.

Figure 6:
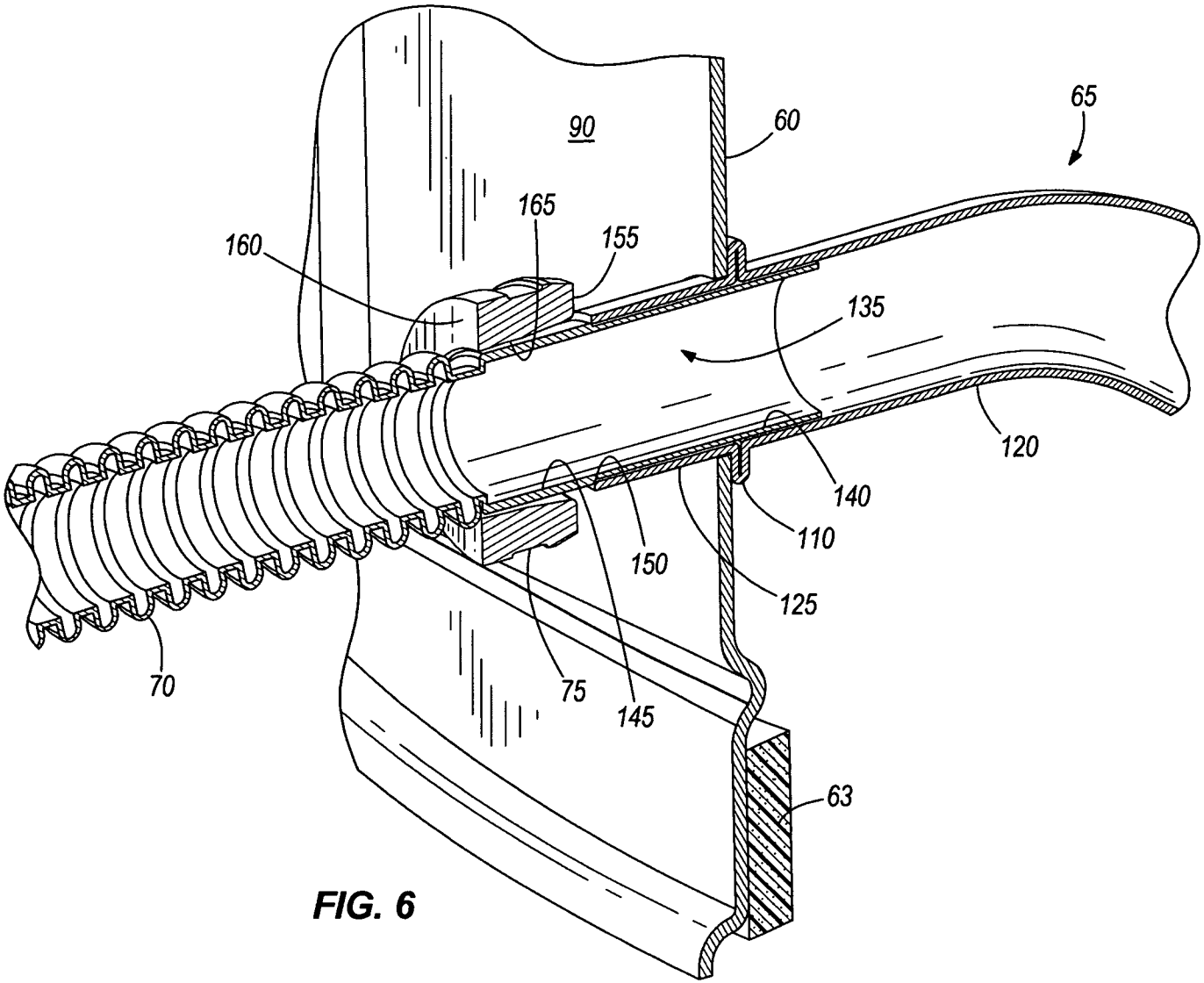
FIG. 6 is a perspective cross-sectional view of a step in the assembly of the burner tube and door assembly of FIG. 3.
Figure 7:
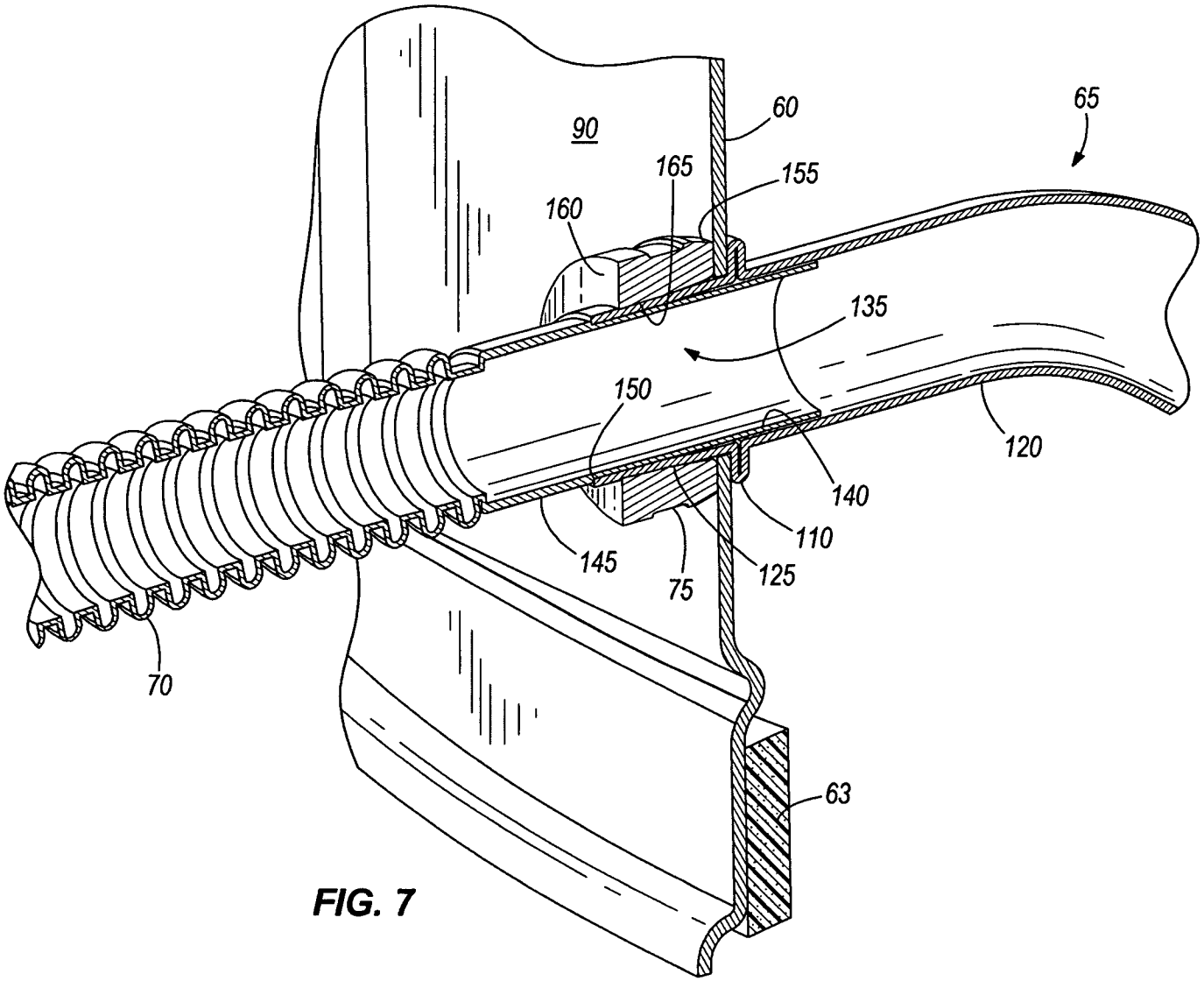
FIG. 7 is a perspective cross-sectional view of another step in the assembly of the burner tube and door assembly of FIG. 3.

As illustrated in FIG. 6, during assembly of the tube-door assembly 55, the lock ring 75 may be positioned around the larger diameter portion 145 of the second end 135 of the gas supply line 70 while the reduced diameter portion 140 is being inserted into the second end 125 of the burner tube 65. With reference to FIG. 7, the lock ring 75 may then be slid over the tube joint, which results in the tapered bore 165 applying a compressive force on the tube joint, particularly at the second end 160 of the lock ring 75 due to the outer diameter of the second end 125 of the burner tube 65 being larger than the diameter of the tapered bore 165 at the second end 160. The compressive force deforms the tube joint or at a minimum applies very high, radially-directed compressive forces to the tube joint around the entire circumference of the tube joint, which results in a mechanical interconnection or a high-friction interface between the gas supply line 70 and burner tube 65. Such mechanical interconnection or high-friction interface in the tube joint resists or prevents the gas supply line 70 from being removed from the burner tube 65 during ordinary operation of the water heater 10.

In assembling the tube-door assembly 55, the lock ring 75 is initially positioned around the smaller diameter element in the tube joint, which in the illustrated embodiment is the gas supply line 70. The lock ring 75 is then slid over the larger diameter element in the tube joint, which in the illustrated embodiment is the burner tube 65. In other embodiments, the burner tube 65 may be of smaller outer diameter than the inner diameter of the gas supply line 70, but such arrangement would result in the lock ring 75 sliding over the gas supply line 70, abutting the inner side 85 of the door 60, and being directly exposed to the temperatures in the combustion chamber 30. While such an arrangement would hide the lock ring 75 inside the combustion chamber 30 when the water heater 10 is assembled, it may also dictate that the lock ring 75 be constructed of a material that can withstand higher temperatures than a lock ring 75 on the outer side 90 of the door 60 as illustrated. The cost and availability of such higher temperature materials should be considered as part of the design process for a tube-door assembly 55 according to the present invention.

Referring again to FIGS. 3 and 4, the tube-door assembly 55 supports a burner assembly that includes a burner 175 and a support bracket 180 mounted to the first end 120 of the burner tube 65. The burner 175 may include an air duct 185 as illustrated, for the receipt of primary combustion air (e.g., flowing into the combustion chamber 30 through the window 58 and flame trap 59) that is mixed with fuel from the fuel supply orifice prior to combustion. The bracket 180 supports the pilot flame line 91, the thermocouple 92, and the pilot flame igniter 93, which support operation of the burner 175. During operation, the burner 175 combusts the mixture of primary air and gaseous fuel to create products of combustion. The products of combustion move up through the flue 35 and heat water in the storage tank 15 through convection and conduction.

Each of the bead 110 and the lock ring 75 has an outer diameter that is larger than the hole diameter 105. Consequently, the lock ring 75 abuts the outer side 90 of the door 60 to prevent movement of the tube joint in a first direction through the hole 100 (i.e., toward the combustion chamber 30), and the bead 110 abuts the inner side 85 of the door 60 to prevent movement of the tube joint in a second, opposite direction through the hole 100 (i.e., away from the combustion chamber 30).

In one assembly technique contemplated by the present invention, the bead 110 and lock ring 75 are pushed toward each other against the opposite sides of the door 60, slightly compressing at least one of the bead 110, lock ring 75, and door 60. When released, at least one of the bead 110, lock ring 75, and door 60 naturally attempt to expand away from the door 60 due to the natural elasticity of the materials, but the second end 160 of the tapered bore 165 of the lock ring 75 bites into the burner tube 65 to resist such expansion. The result of such assembly technique is a permanent compressive load on the door 60. The door joint (including the door 60, burner tube 65, supply tube 70, and lock ring 75) may be said to be pre-loaded with a compressive force during assembly. The compressive load on the door 60 gives rise to friction between the door's inner and outer sides 85, 90 and the respective bead 110 and lock ring 75. Such friction resists rotation of the door 60 with respect to the burner tube 65, and the door 60 may be said to be "sandwiched" between the bead 110 and lock ring 75. The compressive pre-load also creates a seal around the hole 100 in the door 60. In other embodiments in which a seal is not required or desired, one of the bead 110, lock ring 75, and hole 100 may have a shape or size such that the hole 100 is not entirely covered by the bead 110 and lock ring 75.

Figure 8:
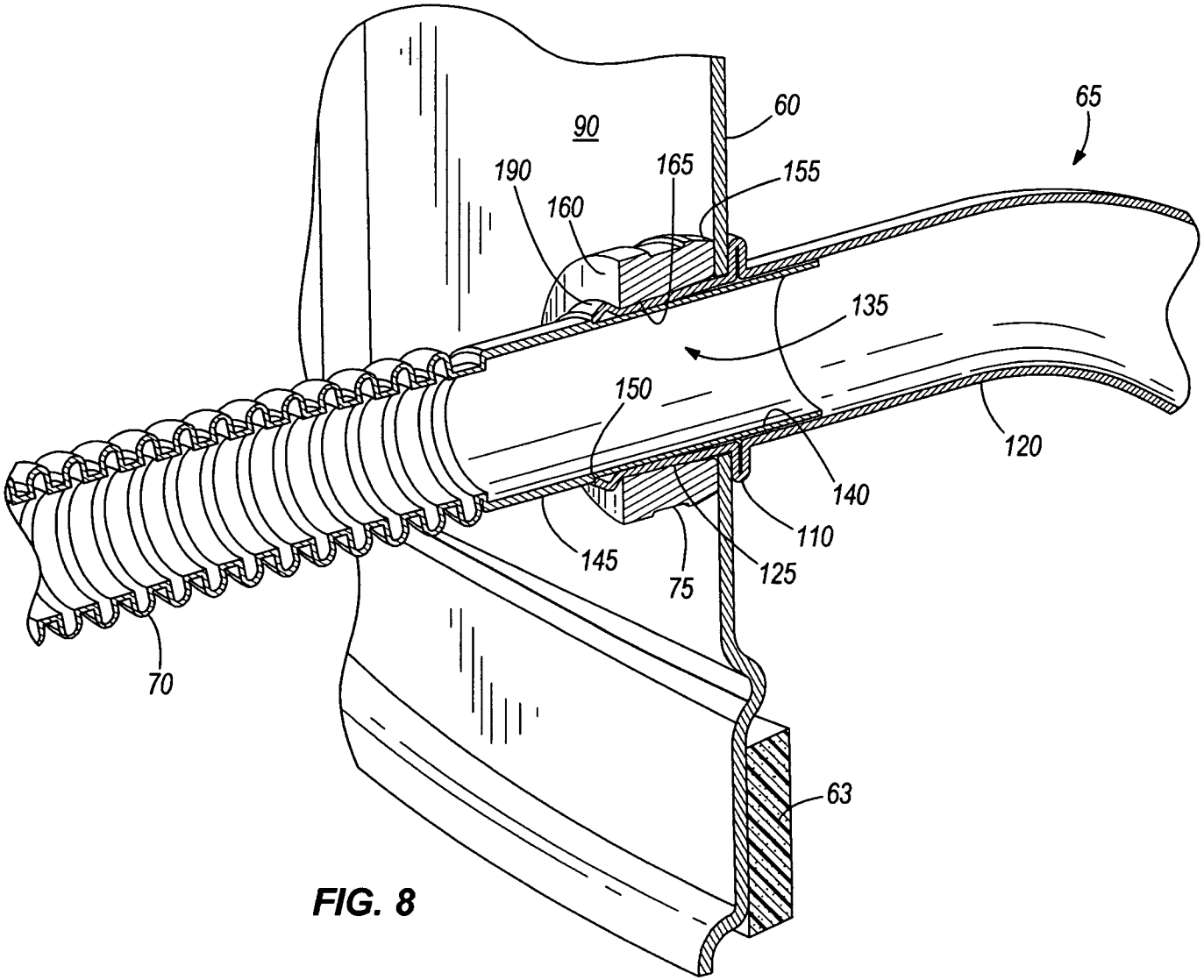
FIG. 8 is a perspective cross-sectional view of an alternative finishing step in the assembly of the burner tube and door assembly of FIG. 3.

FIG. 8 illustrates an additional finishing detail that may be employed to further secure the lock ring 75 on the tube joint. In this embodiment, the free, distal end of the second end 125 of the burner tube 65 (i.e., the free end of the burner tube 65 that extends beyond the lock ring 75 after installation of the lock ring 75 on the tube joint) is disrupted, tented, bent, or swaged to create an enlarged diameter bulge or bead 190 that resists movement of the lock ring 75 away from the door 60.

Figure 9:
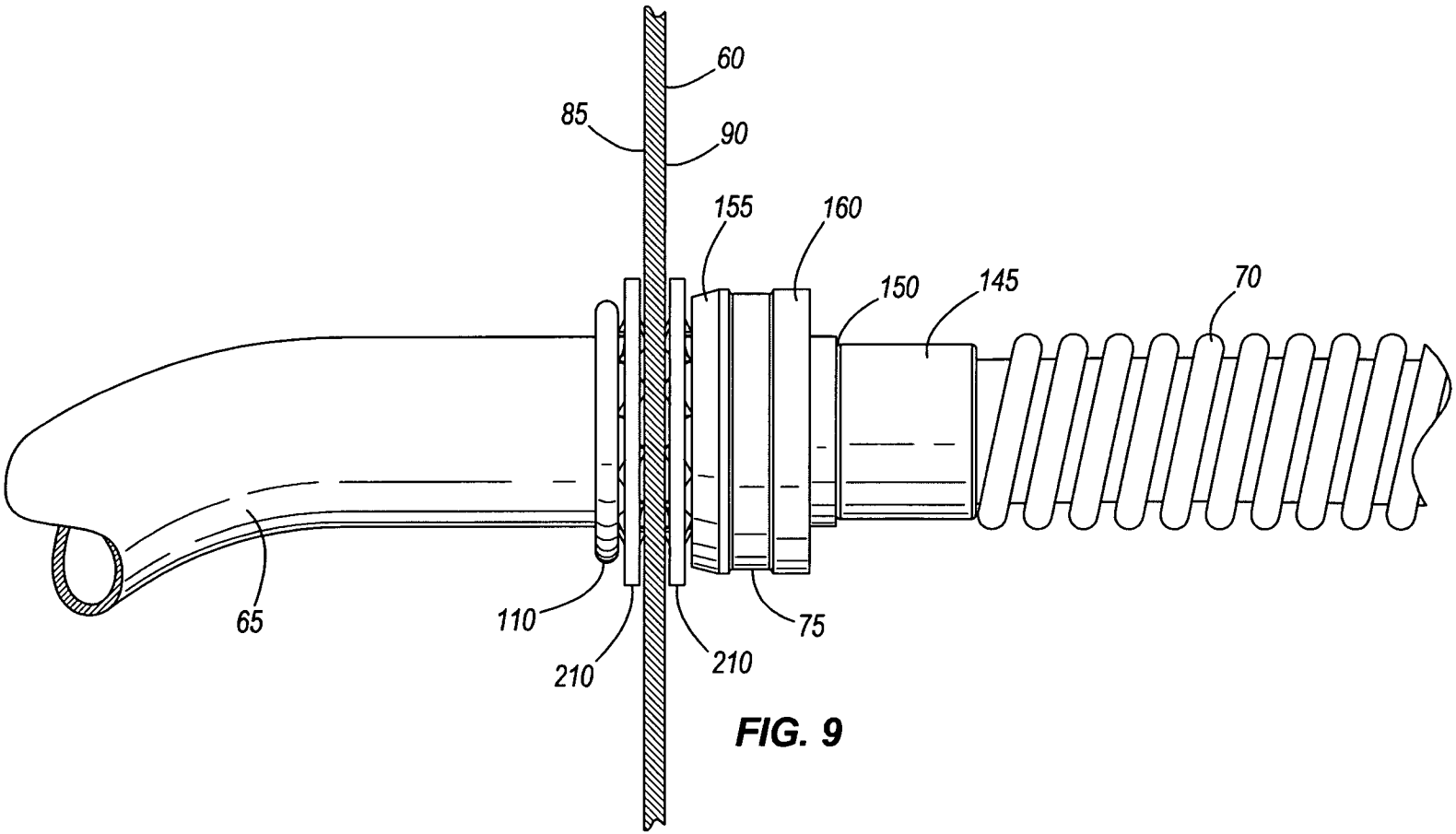
FIG. 9 is a side view of an alternative embodiment of the burner tube and door assembly.

With reference to FIG. 9, friction washers 210 may, in other embodiments, be interposed between the bead 110 and the door 60 and between the lock ring 75 and the door 60 to increase friction in the assembly. In the illustrated embodiment, there is a friction washer 210 on both sides of the door 60, but in other embodiments one of the friction washers 210 may be eliminated. In both illustrated embodiments, the joint defined by the lock ring 75, door 60, and bead 110 relies entirely on axial compression to secure the door 60 to the burner tube 65 and to resist rotation of the door 60 with respect to the burner tube 65.

Trapping or sandwiching the door 60 between the lock ring 75 and bead 110 (whether or not with one or both of the interposed friction washers 210) has at least two advantages over known door 60 assemblies: (1) there is no metallurgic bonding, such as welding or brazing, required in the joint to secure the door 60 between the bead 110 and lock ring 75; and (2) the lock ring 75 performs two functions with a single element, namely, compressively sealing the burner tube 65 to the supply line 70 and compressively securing the door 60 against the bead 110.

Thus, the invention provides, among other things, a novel tube-door assembly for a water heater. Various features and advantages of the invention are set forth in the following claims.

What is claimed is:

1. A water heater comprising:

a water storage tank;

a combustion chamber having an access opening;

a door adapted to cover the access opening, the door including a hole having a hole diameter, and including an inner surface facing the combustion chamber and an outer surface facing away from the combustion chamber;

a burner tube including an enlarged diameter portion having a outer diameter larger than the hole diameter, a first end on a first side of the enlarged diameter portion and extending into the combustion chamber, and a second end on a second side of the enlarged diameter portion opposite the first side, the first end defining a fuel delivery orifice, the second end having an outer diameter smaller than the hole diameter and extending through the hole in the door;

a burner mounted to the first end of the burner tube and adapted to receive fuel from the fuel delivery orifice to create products of combustion to heat water in the storage tank;

a fuel supply line having a first end adapted for connection to a source of fuel and a second end extending into the second end of the burner tube to define a tube junction; and a lock ring having an outer diameter larger than the hole diameter, and including a first end, a second end, and a tapered bore that has a larger diameter at the first end than at the second end, the lock ring surrounding at least a portion of the tube junction and applying a radially-directed force around a circumference of the tube junction to resist removal of the fuel supply line from the burner tube;

wherein the enlarged diameter portion of the burner tube resists movement of the first end of the burner tube out of the combustion chamber through the hole in the door; and wherein the lock ring resists movement of the supply line into the combustion chamber through the hole in the door.

2. The water heater of claim 1, wherein the lock ring, door, enlarged diameter portion, second end of the burner tube, and second end of the supply line interact to apply compression on the door between the lock ring and enlarged portion to resist relative rotation between the door and the burner tube.

3. The water heater of claim 1, further comprising at least one washer between the door and at least one of the enlarged diameter portion of the burner tube and the lock ring.

4. The water heater of claim 3, wherein the at least one washer includes at least one lock washer compressed between the door and at least one of the enlarged diameter portion and the lock ring.

5. The water heater of claim 3, wherein the at least one washer includes a lock washer compressed between the enlarged diameter portion and the inner surface of the door and a lock washer compressed between the lock ring and the outer surface of the door.

6. A water heater comprising:

a water storage tank;

a combustion chamber having an access opening;

a door adapted to cover the access opening, the door including a hole having a hole diameter, and including an inner surface facing the combustion chamber and an outer surface facing away from the combustion chamber;

a burner tube including an enlarged diameter portion having a outer diameter larger than the hole diameter, a first end on a first side of the enlarged diameter portion and extending into the combustion chamber, and a second end on a second side of the enlarged diameter portion opposite the first side, the first end defining a fuel delivery orifice, the second end having an outer diameter smaller than the hole diameter and extending through the hole in the door;

a burner mounted to the first end of the burner tube and adapted to receive fuel from the fuel delivery orifice to create products of combustion to heat water in the storage tank;

a fuel supply line having a first end adapted for connection to a source of fuel and a second end extending into the second end of the burner tube to define a tube junction; and a lock ring having an outer diameter larger than the hole diameter, the lock ring surrounding at least a portion of the tube junction and applying a radially-directed force around a circumference of the tube junction to resist removal of the fuel supply line from the burner tube;

wherein the enlarged diameter portion of the burner tube resists movement of the first end of the burner tube out of the combustion chamber through the hole in the door; and wherein the lock ring resists movement of the supply line into the combustion chamber through the hole in the door;

wherein the second end of the fuel supply line includes a reduced diameter portion, a larger diameter portion, and a shoulder in between the reduced diameter portion and larger diameter portion; wherein the reduced diameter portion extends into the second end of the burner tube until the burner tube abuts the shoulder; wherein the larger diameter portion has an outer diameter that is less than the outer diameter of the second end of the burner tube; and wherein the lock ring is slid axially off the larger diameter portion and onto the second end of the burner tube during assembly to give rise to the radially-directed force around the entire circumference of the tube junction.

7. A burner tube and door assembly comprising:

a door including an opening, and including oppositely-facing inner and outer surfaces;

a burner tube including opposite first and second ends, the first end of the burner tube adapted to support and deliver gaseous fuel to a burner;

a fuel supply line including opposite first and second ends, the first end of the fuel supply line adapted to interconnect to a source of gaseous fuel, the second end of the fuel supply line sized to interconnect with the second end of the burner tube in telescoping relationship to define a tube junction; and a lock ring including a first end, a second end, and a tapered bore that has a larger diameter at the first end than at the second end, the lock ring receiving the tube junction in the tapered bore and applying a radially-directed force around a portion of the tube junction to resist relative movement of the second ends of the burner tube and fuel supply line;

wherein one of the burner tube and fuel supply line includes an enlarged portion that resists movement of the tube junction in a first direction through the opening in the door; and wherein the lock ring resists movement of the tube junction in a second direction through the opening in the door.

8. The assembly of claim 7, wherein the burner tube includes the enlarged portion; and wherein the second end of the fuel supply line extends into the second end of the burner tube.

9. The assembly of claim 7, further comprising at least one washer between the door and at least one of the enlarged portion and the lock ring.

10. The assembly of claim 9, wherein the at least one washer includes at least one lock washer compressed between the door and at least one of the enlarged portion and the lock ring.

11. The assembly of claim 9, wherein the at least one washer includes a lock washer compressed between the enlarged portion and an inner surface of the door and a lock washer compressed between the lock ring and an outer surface of the door.

12. The assembly of claim 7, wherein the lock ring, door, enlarged portion, second end of the burner tube, and second end of the supply line interact to apply compression on the door between the lock ring and enlarged portion to resist relative rotation between the door and the burner tube.

13. The assembly of claim 7, wherein the radially-directed force mechanically deforms the tube junction.

14. A method of assembling a burner tube and door assembly for a water heater, the method comprising the steps of:

(a) providing a door having an opening;

(b) a burner tube;

(c) forming an enlarged portion in the burner tube to divide the burner tube into a first end on a first side of the enlarged portion and a second end on a second side of the enlarged portion opposite the first side, the enlarged portion being larger than a portion of the opening;

(d) extending the second end of the burner tube through the opening;

(e) providing a fuel supply line having a first end adapted for connection to a source of fuel and a second end opposite the first end;

(f) extending the second end of the fuel supply line into the second end of the burner tube to define a tube junction; and (g) positioning a lock ring having a first end, a second end, and a tapered bore that has a large diameter at the first end then at the second end around the fuel supply line;

(h) sliding the lock ring over the tube junction such that the tapered bore applies a radially-directed force around a circumference of the tube junction to resist removal of the fuel supply line from the burner tube.

15. The method of claim 14, further comprising: prior to step (h), compressing the door between the lock ring and enlarged portion; and following step (h), maintaining compression on the door between the lock ring and enlarged portion.

16. The method of claim 14, further comprising the step of positioning at least one washer between the door and at least one of the enlarged diameter portion of the burner tube and the lock ring.

17. The method of claim 14, further comprising the step of positioning a lock washer between the enlarged portion and the door, wherein step (h) includes compressing the door between the enlarged portion and the lock ring, with the lock washer being deformed between the enlarged portion and the door to resist rotation of the door with respect to the burner tube.

18. The method of claim 14, further comprising the step of positioning a lock washer between the lock ring and the door, wherein step (h) includes compressing the door between the enlarged portion and the lock ring, with the lock washer being deformed between the lock ring and the door to resist rotation of the door with respect to the burner tube.

19. The method of claim 14, wherein step (h) includes mechanically deforming the tube junction.

* * * * *